US008464918B1

(12) United States Patent
Harris et al.

(10) Patent No.: US 8,464,918 B1
(45) Date of Patent: Jun. 18, 2013

(54) CHILD RESISTANT CLOSURE FOR UNIT-DOSE PACKAGING

(75) Inventors: Ryan Harris, Sandpoint, ID (US); Les Greer, Sandpoint, ID (US)

(73) Assignee: Unicep Packaging, Inc., Sandpoint, ID (US)

( * ) Notice: Subject to any disclaimer, the term of this patent is extended or adjusted under 35 U.S.C. 154(b) by 633 days.

(21) Appl. No.: 12/697,006

(22) Filed: Jan. 29, 2010

(51) Int. Cl.
*B65D 1/02* (2006.01)

(52) U.S. Cl.
USPC ..... 222/541.6; 222/541.9; 215/48; 215/250

(58) Field of Classification Search
USPC .... 222/541.6, 541.9, 153.05, 153.06; 215/48, 215/355, 50
See application file for complete search history.

(56) References Cited

U.S. PATENT DOCUMENTS

| | | | | |
|---|---|---|---|---|
| 5,065,876 | A * | 11/1991 | Joyce | 215/206 |
| 5,531,707 | A * | 7/1996 | Kers et al. | 604/200 |
| 6,234,333 | B1 * | 5/2001 | Federighi et al. | 215/48 |
| 6,241,132 | B1 * | 6/2001 | Morrison | 222/541.6 |
| 6,264,074 | B1 | 7/2001 | Emilsson | |
| 6,357,626 | B1 | 3/2002 | Zhang et al. | |
| D458,366 | S | 6/2002 | Hellberg et al. | |
| 6,626,308 | B2 * | 9/2003 | Weiler | 215/48 |
| D492,407 | S | 6/2004 | Masuda et al. | |
| D496,833 | S | 10/2004 | Lantz | |
| 6,860,405 | B1 * | 3/2005 | Poynter | 222/23 |
| D534,648 | S | 1/2007 | Zahn et al. | |
| D538,424 | S | 3/2007 | Zahn et al. | |
| D547,860 | S | 7/2007 | Zahn et al. | |
| D551,760 | S | 9/2007 | Zahn et al. | |
| 7,487,894 | B2 | 2/2009 | Zahn et al. | |
| 7,513,397 | B2 | 4/2009 | Zahn et al. | |
| 7,537,131 | B2 * | 5/2009 | Hansen | 220/23.86 |
| 7,540,389 | B2 * | 6/2009 | Fontana | 215/48 |
| 7,562,796 | B2 | 7/2009 | Zahn et al. | |
| 2007/0138215 | A1 | 6/2007 | Zahn et al. | |

OTHER PUBLICATIONS

Justia, Poison prevention packaging standards, Justia:: 16 C.F.R. ss. 1700.15, retrieved on Jan. 29, 2010, at <<http://law.justia.com/us/cfr/title16/16-2.0.1.5.76.0.2.7.html.>>, 2 pages.
Justia, Testing procedure for special packaging, Justia::16 C.F.R. ss. 1700.20, retrieved on Jan. 29, 2010, at <<http://law.justia.com/us/cfr/title16/16-2.0.1.5.76.0.2.8.html>>, 10 pages.

* cited by examiner

*Primary Examiner* — Kevin P Shaver
*Assistant Examiner* — Charles P Cheyney
(74) *Attorney, Agent, or Firm* — Lee & Hayes, PLLC

(57) ABSTRACT

A child resistant dispenser that is child resistant without assistance from secondary child resistant packaging. The child resistant dispenser includes a locking mechanism disposed between a cap and a housing and the cap is frangibly coupled to the housing. The child resistant dispenser may be formed of a single material that is suitable for a blow-fill-seal process.

20 Claims, 9 Drawing Sheets

CHILD RESISTANT CLOSURE FOR UNIT-DOSE PACKAGING

BACKGROUND

Containers exist for holding and selectively dispensing medicinal products. Such devices usually consist of a reservoir for holding the medicinal product and a lid to secure the medicinal product inside the container. Some containers also include a dispenser, such as a dropper, measuring spoon, or cup to aid in dispensing the product to a user. For example, droppers are often built into the lid of a medicine bottle to dispense medicine, such as cold medicines, vitamins or the like, to children. In private households, such dispensers are used by adults to selectively dispense a desired dose of product to children. However, it is often difficult to determine the proper amount of product to be administered, measure the dose, and then dispense the product. Cross contamination between users of the same container/dispenser is also a problem.

Disposable unit-dose dispensers have been developed to dispense a single dose of product to a user. These dispensers are typically opened by simply removing a foil seal or twisting off a breakable tab of the dispenser. However, because these dispensers are easily opened by children, they are generally not suitable for dispensing medicinal products or other products that are potentially hazardous to children. Recently, some manufacturers have begun selling medicinal products in unit-dose dispensers by sealing them in a secondary child-resistant packaging. However, the secondary child-resistant packaging increases the manufacturing cost associated with the product, and has not proven to be sufficiently child resistant.

SUMMARY

This summary is provided to introduce simplified concepts of disposable unit-dose dispensers that are child resistant without the need for secondary child resistant packaging. The dispensers are further described below in the Detailed Description. This summary is not intended to identify essential features of the claimed subject matter, nor is it intended for use in determining the scope of the claimed subject matter.

In one implementation, the dispenser comprises a housing having a reservoir for containing a product to be dispensed. The reservoir has an outlet for dispensing the product from the reservoir. The dispenser may also include a cap frangibly coupled to the housing and sealing the outlet of the reservoir to prevent the product from escaping the reservoir prior to use. Additionally, the unit-dose dispenser comprises a locking mechanism disposed between the cap and the housing. The locking mechanism prevents the cap from being removed until the locking mechanism is released.

In some implementations, the dispenser may be pre-filled with a product to be dispensed. In this implementation, the pre-filled dispenser comprises a housing having a reservoir containing a unit-dose of a product to be dispensed. An outlet is disposed on the reservoir for dispensing the unit-dose of product from the reservoir. The dispenser may also include a cap frangibly coupled to the housing and sealing the outlet of the reservoir to prevent the product from escaping the reservoir prior to use. The pre-filled dispenser also includes a locking mechanism disposed between the cap and the housing, which prevents the cap from being removed until the locking mechanism is released.

In some implementations, the dispensers may be manufactured via a blow-form-seal process. Other manufacturing techniques are also contemplated, for example, a blow-molding process, an injection molding process or any other manufacturing process suitable for forming the dispenser. Depending on the product to be housed in the dispenser and the manufacturing process, the dispenser may comprise a polymer, such as polyethylene, ethyl vinyl alcohol copolymer or any other suitable polymer, mixture or the like that is suitable for forming the dispenser For example, low-density polyethylene (LDPE), high-density polyethylene (HDPE) or, polypropylene (PP) may be used to form the dispenser.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to disposable unit-dose dispensers that are child resistant without assistance from secondary child resistant packaging. The dispenser has a housing with a reservoir for containing a product to be dispensed. The reservoir may be flexible and able to force a unit-dose of product from the reservoir through an outlet disposed on the reservoir. The outlet is sealed by a cap, which prevents the unit-dose of product from escaping the reservoir prior to use. The cap is frangibly coupled to the housing and locked in place by a locking mechanism disposed between the cap and the reservoir. The frangibly coupled cap comprises an interface that is weaker relative to the cap and outlet, so as to break upon application of a predetermined force to allow product to escape the reservoir during use.

In some implementations, the locking mechanism may comprise a pair of tabs extending between the cap and the housing. The tabs may be coupled to the cap at an outer edge of the cap, and may also be coupled to the housing at an outer surface of the housing, such that the tabs provide a strong moment to prevent rotation or bending of the cap relative to the housing. The tabs may be any shape suitable for coupling to the cap and the housing and locking the cap in place to prevent the cap from rotating. For example, the tabs may be substantially planar in shape, or may be bowed in or out relative to the housing. Moreover, each the tab of the pair of tabs may comprises a failure zone that is weaker than the remainder of the tab. Thus, the tabs are configured to break at the failure zones upon application of a predetermined force.

In some implementations, the locking mechanism is designed to be released by breaking the tabs using a first operation (e.g., pressing the tabs inward toward a center of the housing), while the cap is designed to be removed using a second operation (e.g., rotation or bending). In that case, the locking mechanism prevents the second operation from being performed until after the first operation has been performed. Thus, to open the dispenser, a user must perform two different operations in the proper order. This combination of operations reduces the likelihood that a child will be able to open the dispenser, or that the dispenser will be opened inadvertently. In some implementations, dispensers having the locking mechanisms described herein meet the standards to be regarded as "special packaging" within the meaning of section 2(4) of the Consumer Product Safety Commission, Poison Prevention Packaging Standards Act of 1970. In that case, the dispensers meet the Effectiveness Specifications set forth in 16 C.F.R. §1700, including the Child-Resistant Effectiveness Test and the Senior Adult Effectiveness Test.

Illustrative Dispenser

Figure 1A:
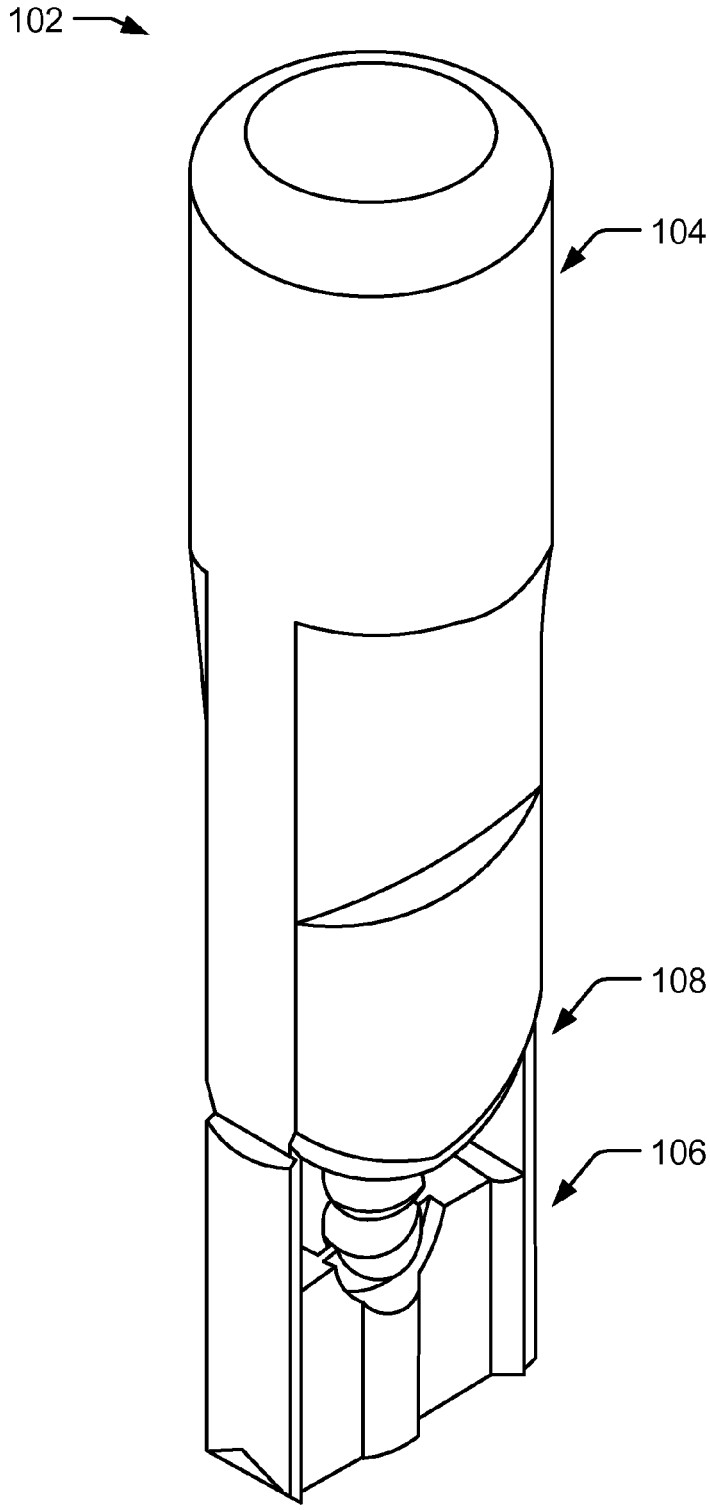
FIG. 1A, FIG. 1B and FIG. 1C illustrate an example dispenser comprising a housing, a cap frangibly coupled to the housing, and a locking mechanism disposed between the cap and the housing.

FIG. 1A is a perspective view of an illustrative dispenser 102 comprising a housing 104, a cap 106 frangibly coupled to the housing 104, and a locking mechanism 108 disposed generally between the cap 106 and the housing 104.

Figure 1B:
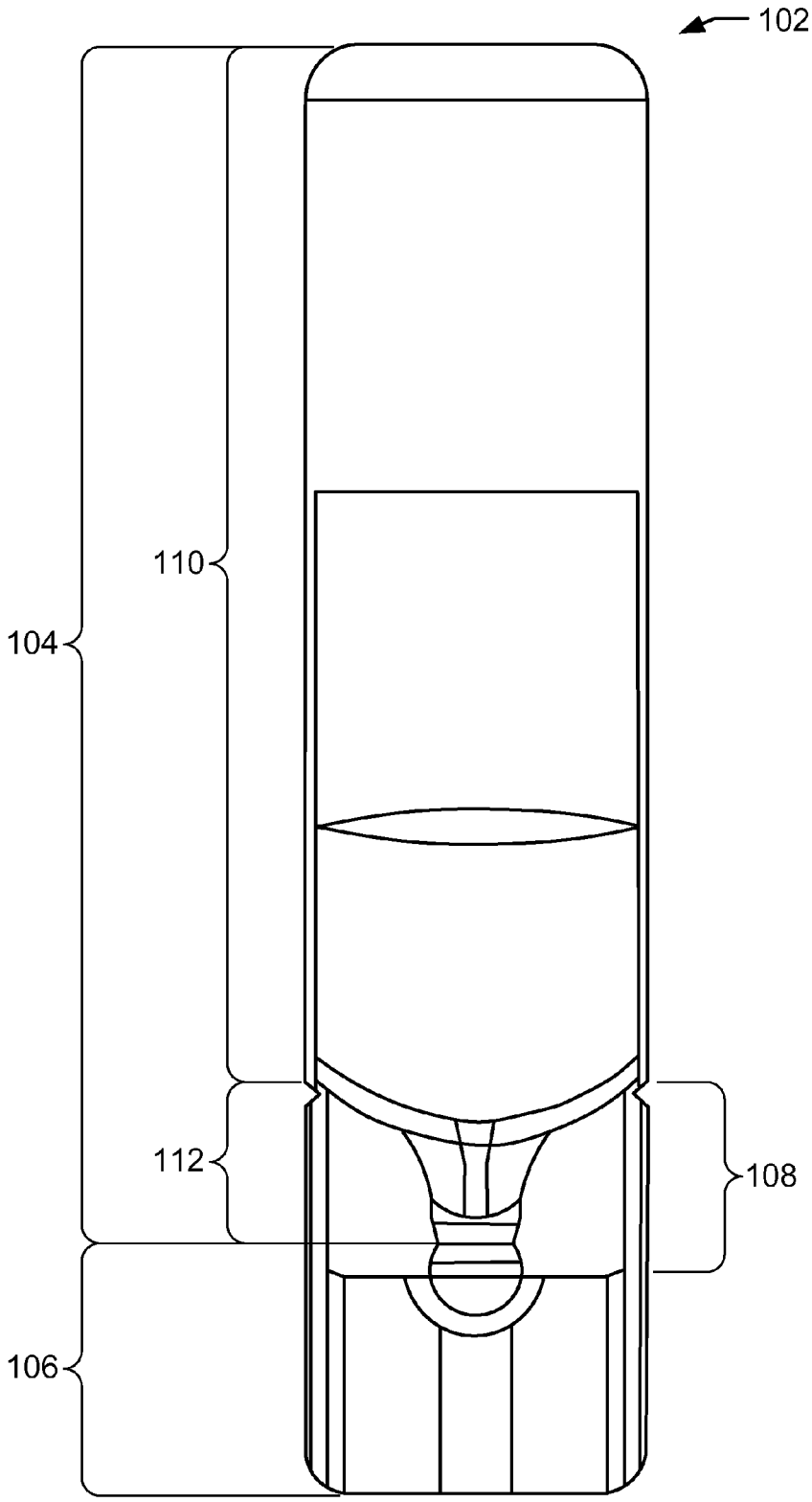

FIG. 1B is a front view of the dispenser 102 showing additional details of the housing 104, cap 106, and locking mechanism 108. As shown, housing 104 comprises a squeezable reservoir 110 and an outlet 112 integral to the reservoir 110. While, FIG. 1B illustrates a housing comprising a squeezable reservoir 110, other reservoirs are contemplated. For example, in other embodiments, the reservoir may be rigid the product may be configured to be poured out of the outlet. In that case, to assist in evacuating the product from the reservoir, the outlet may be made larger and/or a second vent hole may be provided to allow air to enter the reservoir as the product is evacuated.

Referring back to the embodiment of FIG. 1B, the outlet 112 is illustrated as being generally nipple-shaped, however other shapes are contemplated. For example, outlet 112 may be disc-shaped, spoon-shaped, cone-shaped or any other shape suitable for dispensing product from the reservoir 110.

Figure 1C:
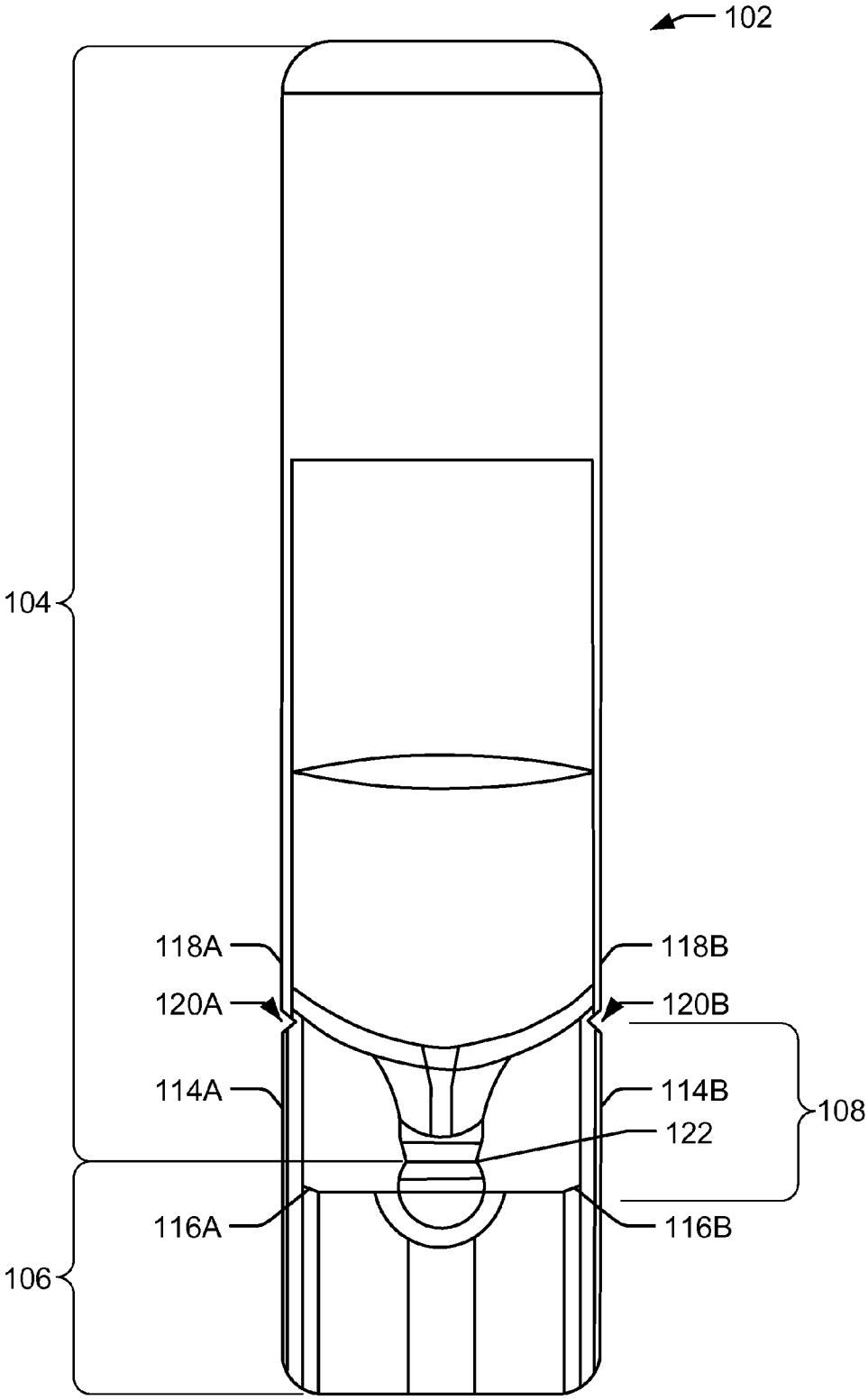

FIG. 1C illustrates the cap 106 being frangibly coupled to the housing 104 and locked in place by a locking mechanism 108 in the form of a pair of tabs 114A and 114B. Here, the pair of tabs 114A and 114B is illustrated as extending between the cap 106 and the housing 104. Further, in this example, the pair of tabs 114A and 114B may be coupled to the cap 106 at or near outer edges 116A and 116B of the cap 106, and coupled to the housing 104 at or near outer surfaces 118A and 118B of the housing 104. With the pair of tabs 114A and 114B coupled to the housing 104 and the cap 106, the pair of tabs 114A and 114B provides a strong moment to prevent rotation or bending of the cap 106 relative to the housing 104.

While FIG. 1C illustrates dispenser 102 comprising a locking mechanism 108 having a pair of tabs 114A and 114B, it is contemplated that any number of tabs could provide a strong moment to prevent rotation of the cap 106 relative to the housing 104. Furthermore, while the pair of tabs 114A and 114B are illustrated in FIG. 1C as being substantially planar in shape, the pair of tabs 114A and 114B may be any shape suitable to provide a strong moment to prevent rotation of the cap 106 relative to the housing 104. For example, the pair of tabs 114A and 114B may be substantially rectangular or bar-shaped. Additionally, while the pair of tabs 114A and 114B are illustrated as being substantially straight relative to the housing, the pair of tabs 114A and 114B may be bowed in or out relative to the housing 104 (as described further with reference to FIGS. 3A and 3B below). Further, the pair of tabs 114A and 114B may be pre-tensioned or pre-stressed, such that subsequent to releasing the locking mechanism 108, the pair of tabs 114A and 114B may spring away from housing 102. For example, the pair of tabs 114A and 114B may spring away from housing and into a latitudinal orientation relative to the housing 104 to prevent over insertion of the dispenser into a mouth of a user. These and other types of locking mechanisms may be used to prevent the cap from being removed prior to release of the locking mechanism.

FIG. 1C further illustrates each of the pair of tabs 114A and 114B comprising failure zones 120A and 120B that are weaker relative to the remainder of each of the tabs 114A and 114B. The tabs 114A and 114B are configured to break at the failure zones 120A and 120B upon application of a predetermined force, thereby releasing the locking mechanism 108. Moreover, after the locking mechanism 108 is released (i.e., failure zones 120A and 120B are broken), the cap 106 is no longer prevented from being rotated and may then be easily removed.

FIG. 1C further illustrates interface 122 disposed between the cap 106 and outlet 112 of FIG. 1B. The interface 122 is designed to be weaker relative to the cap 106 and outlet 112 and configured to break upon application of a predetermined force (e.g., twisting or bending the cap relative to the housing). Subsequent to breaking the interface 122, product is allowed to escape the reservoir 110.

While FIG. 1B illustrates dispenser 102 as comprising a plurality of constituents (i.e., a housing 104, a cap 106, a locking mechanism 108), the dispenser 102 may be formed as an integral unit of a single material. For example, the dispenser 102 and each of the constituents may be formed, using a variety of manufacturing processes, such as injection molding, blow molding, or a blow-fill-seal process. Depending on the product to be contained and the manufacturing process used, the dispenser 102 may be made of a polymer, such as polyethylene, ethyl vinyl alcohol copolymer, low-density polyethylene (LDPE), high-density polyethylene (HDPE), polypropylene (PP) or any other suitable polymer, mixture or the like that is suitable for forming the dispenser 102. Furthermore, while dispenser 102 is illustrated as being substantially funnel-shaped, the dispenser 102 may comprise any other shape suitable for selectively dispensing a unit-dose of product. For example, the dispenser 102 may be substantially cone-shaped, tube-shaped, rectangular-shape, polygonal, oval-shaped, or combinations of any of these. Moreover, while the end of the dispenser 102 opposite the outlet 112 is shown as being substantially flat, the end may alternatively be crimped (e.g., in the case where the dispenser is formed by a blow-fill-seal process).

Figure 2A:
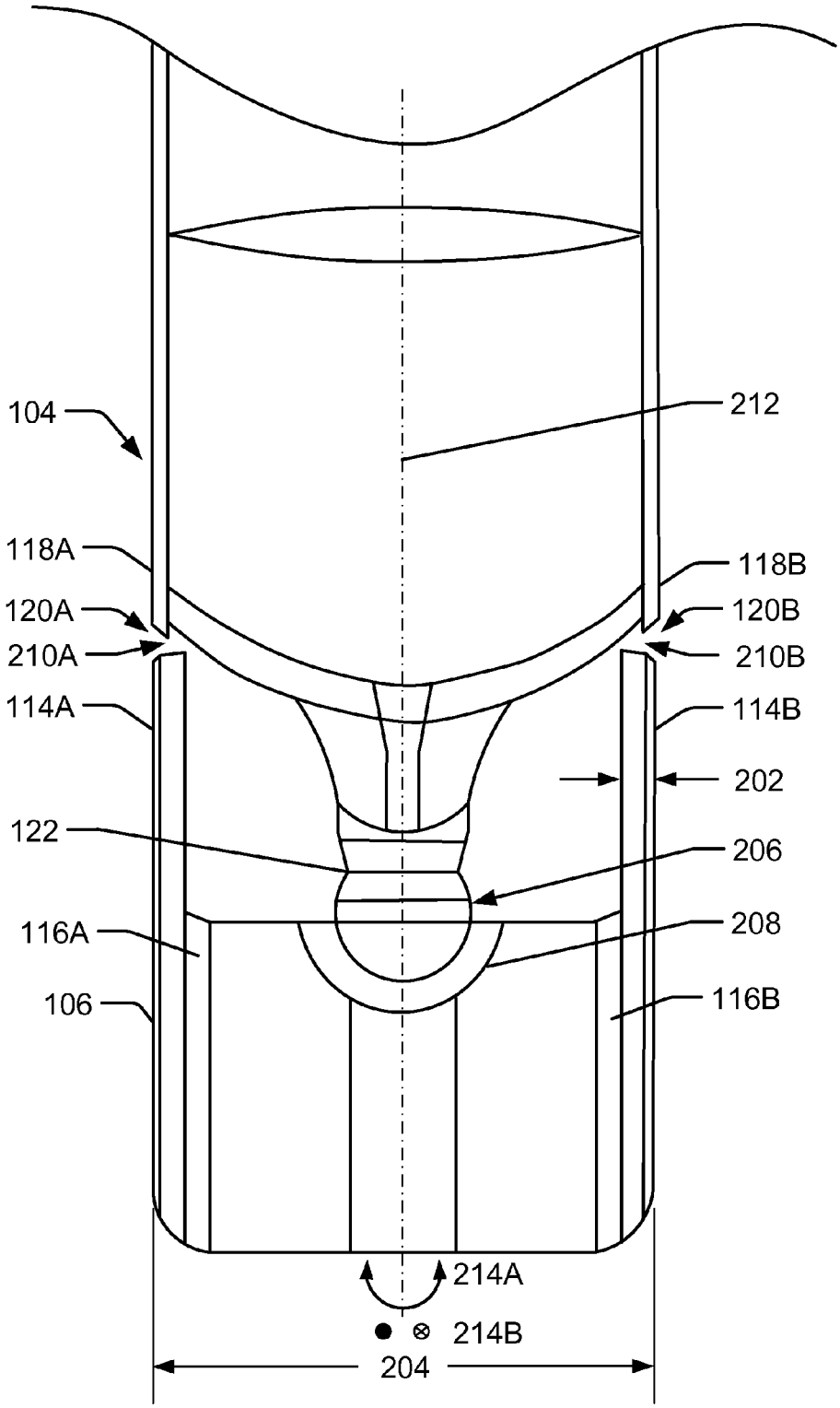
FIG. 2A, FIG. 2B, and FIG. 2C illustrate a front view, a side view and a bottom view, respectively of the dispenser shown in FIGS. 1A-1C in more detail.
Figure 2B:
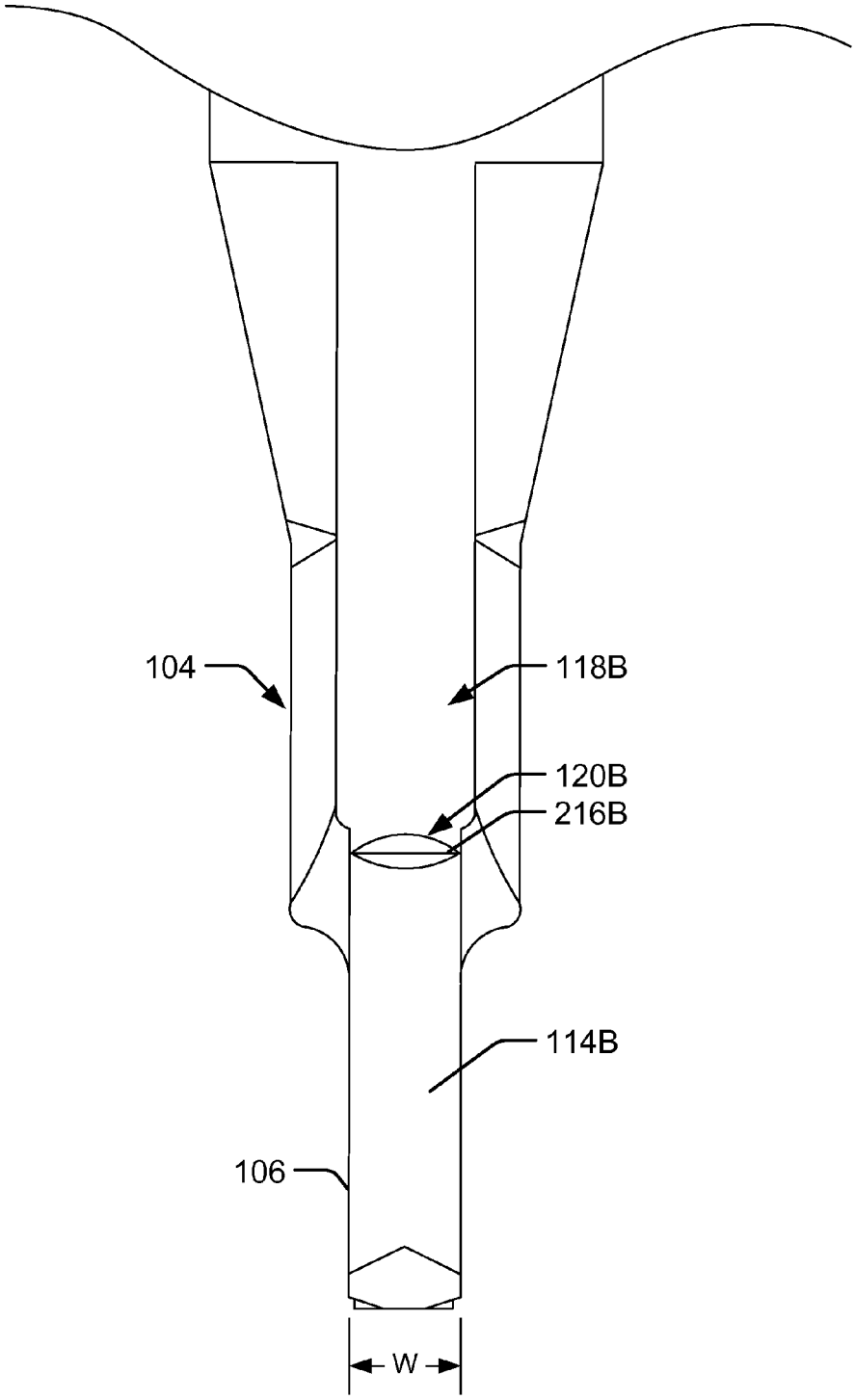
Figure 2C:
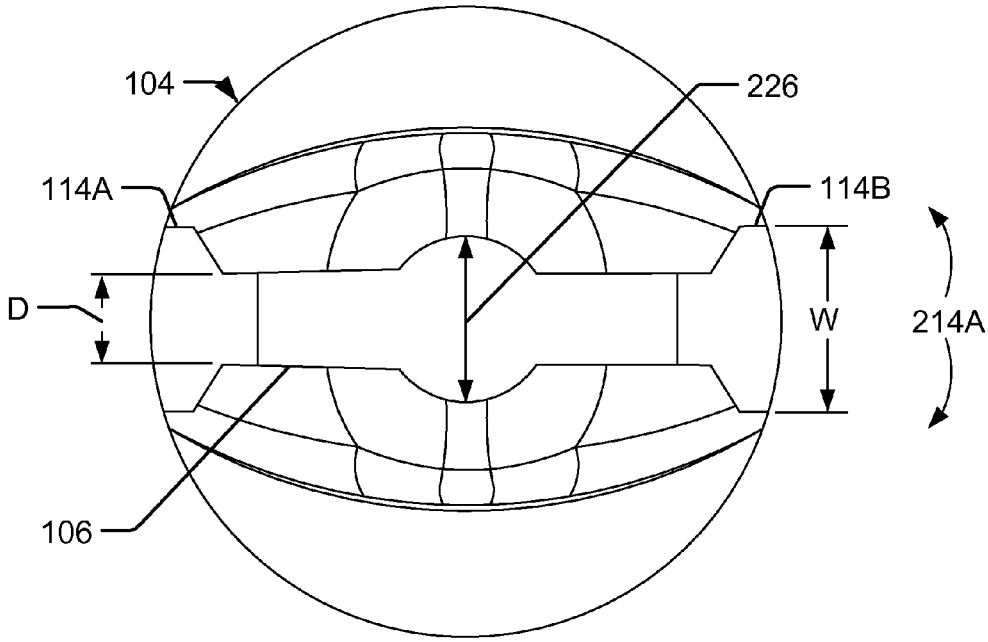

FIGS. 2A-2C illustrate a front view, a side view and a bottom view, respectively, of the dispenser 102 shown in FIGS. 1A-1C in more detail.

FIG. 2A illustrates the locking mechanism 108 and the cap 106 frangibly coupled to the housing 104 in more detail. As discussed above, housing 104 comprises a reservoir 110 and an outlet 112 integral to the reservoir 110. As also discussed above, a pair of tabs 114A and 114B are coupled to the cap 106 at outer edges 116A and 116B of the cap 106, and coupled to the housing 104 at outer surfaces 118A and 118B of the housing 104. FIG. 2A further illustrates a wall thickness of the pair of tabs 114A and 114B coupled to the cap 106 and housing 104. In the illustrated example, the tabs 114A and 114B have a wall thickness 202 of about 0.02 inches (about 0.5 millimeters) extending a majority of the length of the pair of tabs 114A and 114B, except at the failure zones 120A and 120B, where the wall thickness reduces to about 0.01 to 0.005 inches (about 0.26 to 0.18 millimeters).

FIG. 2A illustrates the cap 106 as generally rectangular-shaped and substantially the same width 204 as the housing 104. Also illustrated in FIG. 2A is a nodule 206. Nodule 206 is fixed to the cap 106 in a pocket 208 substantially near the center of cap 106 and frangibly coupled to the outlet 112 at interface 122. As described above, after the locking mechanism 108 is released (e.g., failure zones 210A and 210B are broken), the cap 106 is free to rotate. Upon releasing the locking mechanism 108 and subsequently rotating and/or bending the cap 106 about longitudinal axis 212, a predetermined rotational force 214A about the longitudinal axis 212 and/or a predetermined transverse force 214B relative to the longitudinal axis 212 may be translated to nodule 204. When the rotating cap 106 produces either predetermined force 214A or 214B the interface 122 will be broken. Subsequent to the breaking of the interface 122, the cap 106 is free of the dispenser 102 and the product contained in reservoir 110 is free to escape the reservoir 110.

FIG. 2B illustrates tab 114B of the locking mechanism 108 in more detail. As discussed above, and as illustrated in FIG. 1B, the pair of tabs 114A and 114B comprise failure zones 120A and 120B that are weaker relative to the remainder of the pair of tabs 114A and 114B. Each of pair tabs 114A and 114B is configured to break at the failure zones 120A and 120B upon application of a predetermined force and thereby releasing the locking mechanism 108. Here, in FIG. 2B, failure zone 120B is shown comprising a score line 216B. While not shown, failure zone 120A comprises the same score line 216A. Furthermore, while failure zone 120B is illustrated as a score line in this embodiment, other failure zone mechanisms are contemplated. For example, failure zone 120B may be a perforated line, a notch, a hole, a thin section, or any other suitable mechanism for providing a failure zone.

FIG. 2B further illustrates the failure zones 120A and 120B being disposed on the pair tabs 114A and 114B closer to the housing 104 than to the cap 106. However, the failure zones 120A and 120B may be disposed anywhere along the pair of tabs 114A and 114B. For example, the failure zones 120A and 120B may be disposed on the pair of tabs 114A and 114B closer to the cap 106 than to the housing 104, or midway between the housing 104 and the cap 106. The tabs 114A and 114B have a width W, which is sufficient to provide a strong moment to prevent rotation of the cap before the tabs are broken.

FIG. 2C, illustrates the bottom view of the dispenser 102 shown in FIGS. 1A-1C in more detail. Specifically, FIG. 2C illustrates the pair of tabs 114A and 114B are substantially planar relative to housing 104. FIG. 2C illustrates a cap depth D, which is relatively smaller than tab width W. Also illustrated in FIG. 2C is a center diameter 226 of cap 106, which is substantially concentric to housing 104. The center diameter 226 of cap 106 is substantially the same size as the nodule 204 (not shown). In the illustrated example, the cap depth D is about 0.03 inches (about 0.76 millimeters), the tab width W is at least about 0.1 inches (about 2.5 millimeters) and the center diameter is about 0.1 inches (about 2.54 millimeters). As discussed above, the dispenser 102 in this example is substantially funnel-shaped and symmetrical about longitudinal axis 212.

Alternative Illustrative Locking Mechanism

Figure 3B:
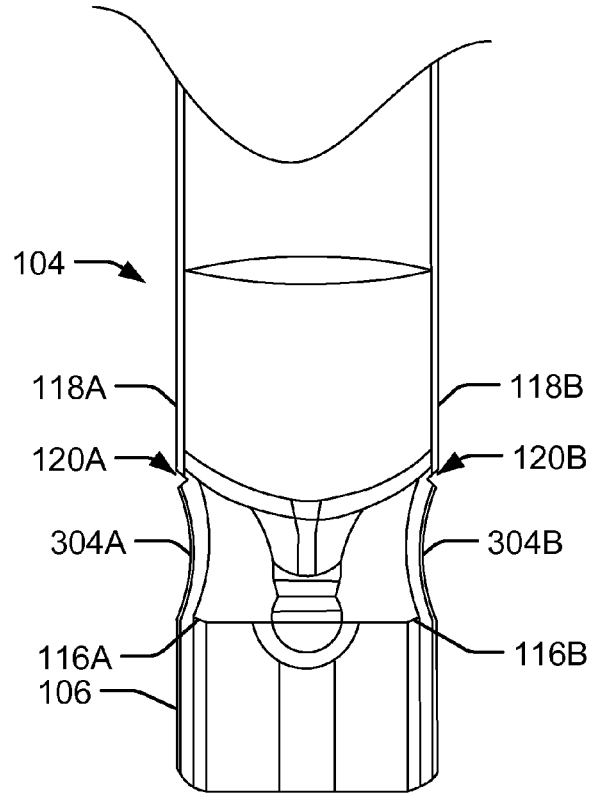
FIG. 3A and FIG. 3B illustrate example embodiments of the locking mechanism disposed between the cap and the housing 104 shown in FIG. 1.
Figure 3A:
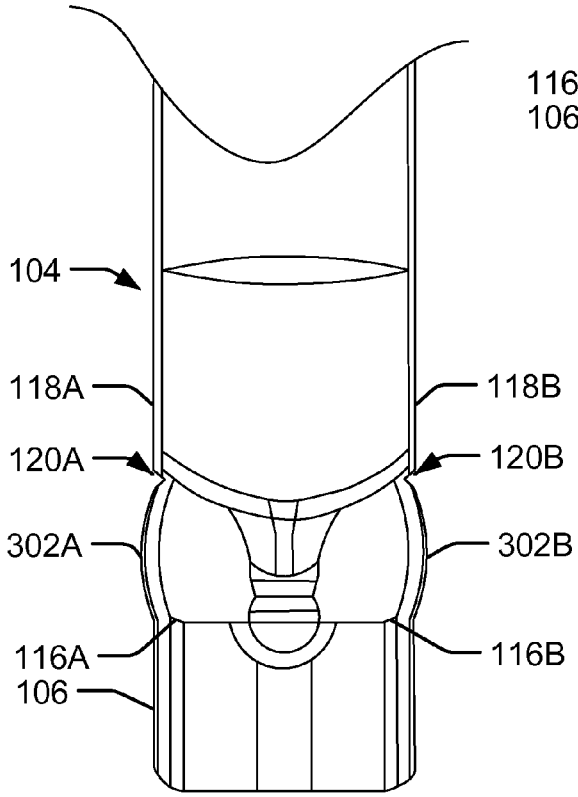

FIG. 3A and FIG. 3B illustrate alternative embodiments of the locking mechanism 108 disposed between cap 106 and housing 104 shown in FIG. 1.

FIG. 3A illustrates a locking mechanism 108 with a pair of tabs 302A and 302B that are bowed out relative to the housing 104. Similarly, as discussed above the pair of bowed tabs 302A and 302B may be coupled to the cap 106 at outer edges 116A and 116B of the cap 106, and coupled to the housing 104 at outer surfaces 118A and 118B of the housing 104. Here, again the pair of bowed tabs 302A and 302B may comprise failure zones 120A and 120B that are weaker relative to the remainder of the pair of bowed tabs 302A and 302B. Each tab of the pair of bowed tabs 302A and 302B are configured to break at the failure zones 120A and 120B upon application of a predetermined force and thereby releasing the locking mechanism 108. While FIG. 3A illustrates the failure zones 120A and 120B being disposed closer to the housing 104 than to cap 106, failure zones 120A and 120B may be disposed anywhere along the length of the pair of bowed tabs 302A and 302B. With the pair of bowed tabs 302A and 302B coupled to the housing 104 and cap 106, the pair of bowed tabs 302A and 302B provide a strong moment to prevent rotation of the cap 106 relative to the housing 104. Further, tabs 302A and 302B may be pre-tensioned such that subsequent to releasing the locking mechanism 108 (i.e., the failure zones 120A and 120B are broken), the pair of bowed tabs 302A and 302B may spring away from housing 102. For example, the pair of bowed tabs 302A and 302B may spring away from housing and into a substantially latitudinal orientation relative to the housing 104. Specifically, with the failure zones 120A and 120B being disposed closer to the cap 106 than the housing 104, the pair of bowed tabs 302A and 302B under a preexisting load may spring away from the housing 104 and into a substantially latitudinal orientation relative to the housing 104, thereby serving as a stop to prevent the dispenser from being inserted too far into a user's mouth.

FIG. 3B illustrates a locking mechanism 108 with a pair of bowed tabs 304A and 304B that are bowed in relative to the housing 104, and are otherwise similar to tabs 114A and 114B described above.

Example Process for Using a Unit-Dose Dispenser

Figure 4:
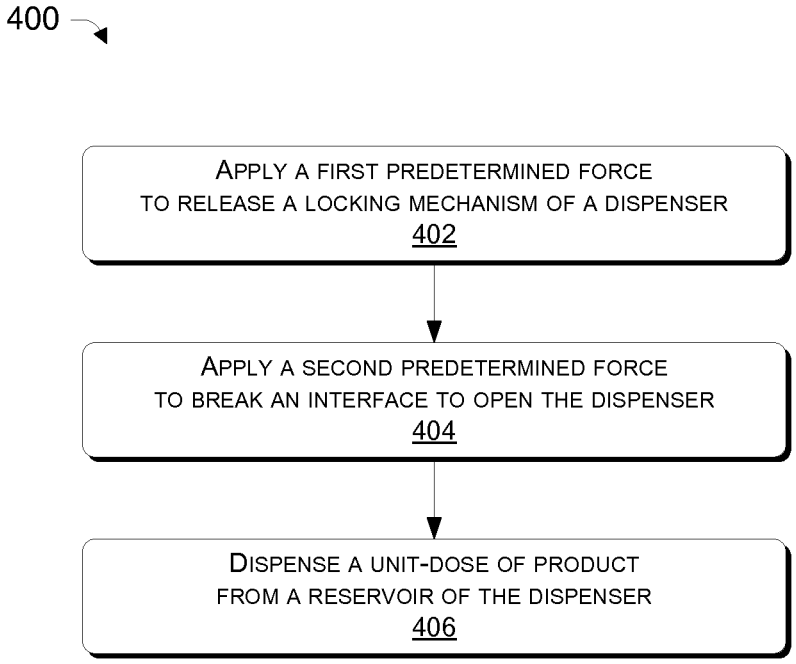
FIG. 4 illustrates an example process 400 of using a unit-dose dispenser.

FIG. 4 illustrates an example process 400 for using a unit-dose dispenser, such as dispenser 102. For instance, this process may be performed by a user intended to be able to selectively use the disposable unit-dose dispenser. More specifically, this process may be performed by a user that is not a child. By design, the dispenser 102 and this process 400, is not intended to be used by children. By way of example and not limitation, the process may be performed at a medical facility (e.g., emergency care center, hospital, doctor's office, or the like), a private residence, a manufacturing facility (e.g., prior to the distribution of the unit-dose dispenser), or the like. While FIG. 4 illustrates a process for using a disposable unit-dose dispenser configured to be child resistant without secondary child resistant packaging and to dispense a unit-dose of product, this process may apply to the use of a dispenser configured to dispense any amount and/or any type of product. For example, the unit-dose dispenser may dispense a unit-dose of chain lube to a bicycle chain, adhesive to bond two materials, or any other product that may be harmful to a child. Moreover, secondary packaging (child resistant or otherwise) may still be used in conjunction with the dispensers described herein.

Process 400 includes an operation 402, which represents a user selectively releasing a locking mechanism (e.g., locking mechanism 108) disposed between a cap (e.g., cap 106) and a housing (e.g., housing 104) by applying a first predetermined force to the locking mechanism. For example, the predetermined force may be applied to a pair of tabs (e.g., pair of tabs 114A and 114B) having failure zones (e.g., failure zones 120A and 120B), which are configured to break upon receiving the predetermined force. Next, process 400 proceeds to operation 404, which represents rotating the cap about a longitudinal axis (e.g., longitudinal axis 210) or by rotating the cap transverse to the longitudinal axis of the housing, to apply a second predetermined force to an interface (e.g., interface 122) in order to break the interface. Subsequent to breaking the interface, the cap is free of the dispenser and the product contained in reservoir is free to escape the reservoir 110. Process 400 is complete, where at operation 406 the user dispenses a unit-dose of product from a reservoir (e.g., reservoir 110) by squeezing, pouring, or otherwise evacuating the product from the dispenser.

Example Process for Manufacturing a Unit-Dose Dispenser

Figure 5:
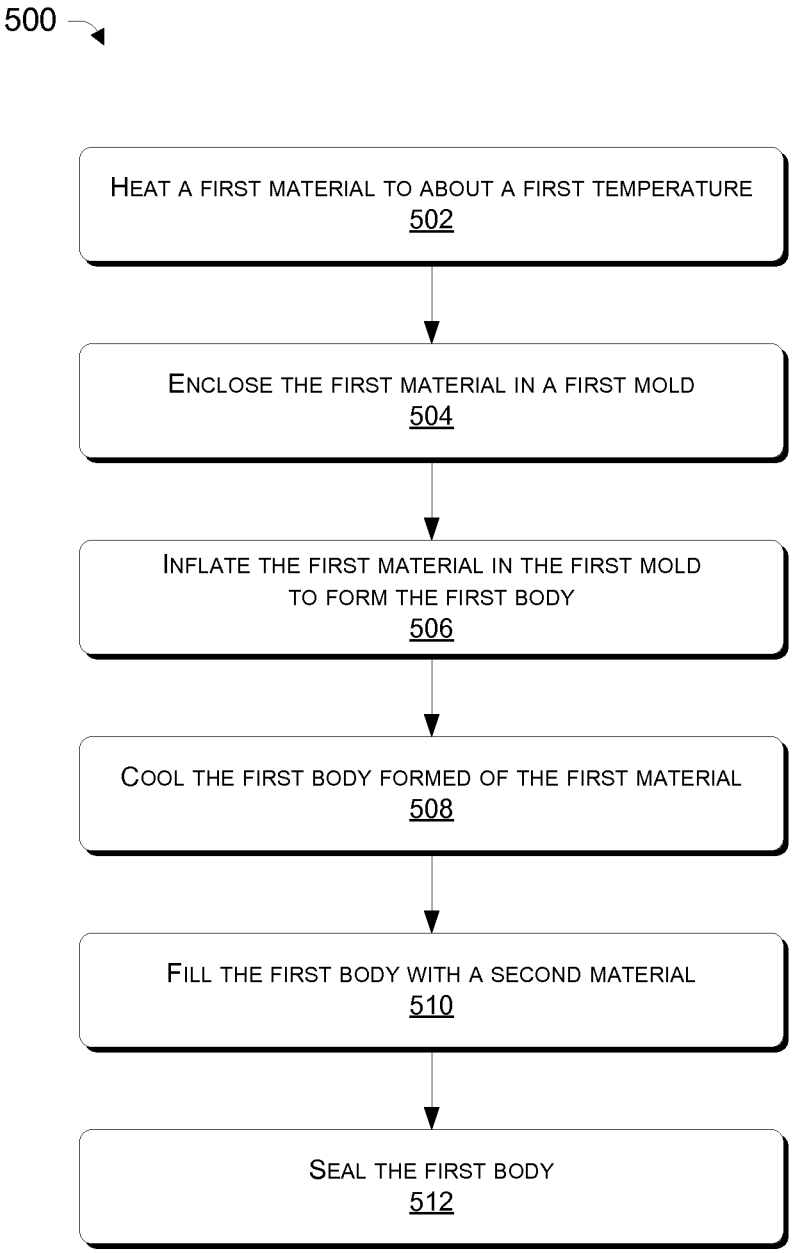
FIG. 5 illustrates an example process 500 of manufacturing a unit-dose dispenser.

FIG. 5 illustrates an example process 500 for manufacturing a unit-dose dispenser (e.g., dispenser 102) based at least in part on material characteristics of the particular unit-dose dispenser. For instance, this process may be performed to manufacture a unit-dose dispenser comprising a unit formed of a single material. For example, the unit-dose dispenser and each of the unit-dose dispenser's constituents may be formed of a polymer, such as polyethylene, polypropylene, ethyl vinyl alcohol copolymer or any other suitable polymer, mixture or the like that is suitable for forming the unit-dose dispenser. In some instances, the process may be performed at a manufacturing facility prior to the shipping of the unit-dose dispenser. Additionally, the manufacturing facility may be capable of aseptic processing for producing unit dose dispensers. While FIG. 5 illustrates a process for manufacturing a unit-dose dispenser configured to be child resistant without secondary child resistant packaging and to dispense a unit-dose of product, this process may apply to the manufacturing of any type of dispenser. For example, the unit-dose dispenser may be for dispensing a unit-dose of chain lube to a bicycle chain, a unit-dose of adhesive to bond materials, or a unit-dose of energy drink. Additionally, this process may apply to manufacturing any type of dispenser formed of any other suitable materials capable of being manufactured by injection molding, blow molding, blow-fill-seal processing, or any other suitable manufacturing process.

Process 500 includes an operation 502, which represents heating a first material (e.g., polyethylene, polypropylene, ethyl vinyl alcohol copolymer) to a first temperature of about 130 degrees Celsius. Next, process 500 proceeds to operation 504, which represents enclosing the first material in a first mold. The first mold comprising a shape to form a first body. The mold includes cavities and protrusions to form a reservoir (e.g., reservoir 110) for containing a unit-dose of a product to be dispensed, an outlet (e.g., outlet 108) disposed on the reservoir for dispensing the product from the reservoir, a cap (e.g., cap 106) for frangibly coupling to the reservoir and sealing the outlet of the reservoir to prevent the product from escaping the reservoir prior to use, and a pair of tabs (e.g., pair of tabs 114A and 114B) that extend between the cap and the housing, and which prevent the cap from being rotated, which act as a locking mechanism for the cap. The mold further is configured to provide a failure zone (e.g., failure zones 120A and 120B) in each tab, the failure zone being weaker relative to the remainder of the tab, such that each tab is configured to break at the failure zone upon application of a predetermined force. Process 500 continues to operation 506, where, a mandrel is used to inflate the first material in the first mold to form the first body. Operation 506 is followed by operation 508 where the first body formed of the first material is cooled to about 50 degrees Celsius. Following operation 508, at operation 510, and subsequent to the cooling of the first body formed of the first material, a mandrel is used to fill the first body with a second material (e.g., medicine, vitamins, or other product). After operation 510, process 500 continues with operation 512, where a second mold is used to seal the first body thereby forming the unit-dose dispenser with a unit-dose of product contained.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative. Also, while one example manufacturing process is described, dispensers according to this disclosure may be made using any other suitable manufacturing process.

What is claimed is:

1. A disposable dispenser comprising:

a housing including:

a reservoir for containing a product to be dispensed; and an outlet disposed on the reservoir for dispensing the product from the reservoir;

a cap frangibly coupled to the housing and sealing the outlet of the reservoir to prevent the product from escaping the reservoir prior to use; and a locking mechanism disposed between the cap and the housing, the locking mechanism preventing the cap from being removed until the locking mechanism is released, wherein the locking mechanism is configured to be released by a first operation comprising a predetermined lateral force asserted on the locking mechanism towards a center of the housing, and the cap is configured to be removed from the housing by a second operation that is different than the first operation, the locking mechanism preventing the second operation until after performance of the first operation.

2. The disposable dispenser of claim 1, wherein the locking mechanism comprises a pair of tabs extending between the cap and the housing, the tabs preventing the cap from being rotated until after performance of the first operation.

3. The disposable dispenser of claim 2, wherein the tabs are substantially planar.

4. The disposable dispenser of claim 2, wherein the tabs are bowed in or out relative to the housing.

5. The disposable dispenser of claim 2, wherein each tab of the pair of tabs comprises a failure zone that is weaker relative to the remainder of the tab, each tab being configured to break at the failure zone upon application of the predetermined lateral force.

6. The disposable dispenser of claim 5, wherein the failure zone comprises a score line, a perforated line, a notch, or a thin section.

7. The disposable dispenser of claim 5, wherein the failure zone is disposed on each tab closer to the housing than to the cap.

8. The disposable dispenser of claim 1, wherein the locking mechanism comprises a pair of tabs coupled to the cap at an outer edge of the cap, and coupled to the housing at an outer surface of the housing, such that the tabs provide a moment to prevent rotation of the cap relative to the housing until after performance of the first operation.

9. The disposable dispenser of claim 1, wherein the dispenser is injection molded, blow molded, injection blow molded, or formed by a blow-fill-seal process.

10. The disposable dispenser of claim 1, further comprising product housed in the reservoir of the housing.

11. A unit-dose dispenser comprising:

a housing including:

a reservoir containing a single dose of a product to be dispensed; and an outlet disposed on the reservoir for dispensing the product from the reservoir;

a cap frangibly coupled to the housing and sealing the outlet of the reservoir to prevent the product from escaping the reservoir prior to use; and a locking mechanism comprising a pair of tabs attached to an outer surface of the housing and on opposite sides of the housing, the pair of tabs extending between the cap and the housing, the locking mechanism preventing the cap from being rotated while the tabs are intact, each tab having a failure zone that is weaker relative to the remainder of the tab, such that each tab is configured to break at the failure zone upon application of a predetermined force wherein the locking mechanism is configured to be released by a first operation comprising a predetermined lateral force asserted on the locking mechanism towards a center of the housing, and the cap is configured to be removed from the housing by a second operation that is different than the first operation, the locking mechanism preventing the second operation until after performance of the first operation.

12. The unit-dose dispenser of claim 11, wherein the tabs are substantially planar.

13. The unit-dose dispenser of claim 11, wherein the tabs are bowed in or out relative to the housing.

14. The unit-dose dispenser of claim 11, wherein the failure zone comprises a score line, a perforated line, a notch, or a thin section.

15. The unit-dose dispenser of claim 11, wherein the failure zone is disposed on each tab closer to the housing than to the cap.

16. The unit-dose dispenser of claim 11, wherein the tabs are coupled to the cap at an outer edge of the cap, such that the tabs provide a moment to prevent rotation of the cap relative to the housing while the tabs are intact.

17. The unit-dose dispenser of claim 11, wherein the dispenser is injection molded, blow molded, injection blow molded, or formed by a blow-fill-seal process.

18. A disposable, unit-dose dispenser comprising:

a housing including:

a reservoir for containing a product to be dispensed; and an outlet disposed on the reservoir for dispensing the product from the reservoir;

a cap coupled to the housing and sealing the outlet of the reservoir to prevent the product from escaping the reservoir prior to use; and a locking mechanism preventing the cap from being removed until the locking mechanism is released, the locking mechanism comprising a pair of tabs frangibly attached to the housing and extending in a substantially parallel manner away from the housing wherein the locking mechanism is configured to be released by a first operation comprising a predetermined lateral force asserted on the locking mechanism towards a center of the housing, and the cap is configured to be removed from the housing by a second operation that is different than the first operation, the locking mechanism preventing the second operation until after performance of the first operation.

19. The disposable dispenser of claim 1, further comprising a frangible coupling that is weaker relative to the remainder of the cap and that is weaker relative to the remainder of the outlet, the frangible coupling disposed between the cap and the outlet.

20. The disposable dispenser of claim 1, wherein the locking mechanism is attached to a distal end of the housing.

* * * * *